US005828810A

United States Patent [19]

Frank et al.

[11] Patent Number: 5,828,810

[45] Date of Patent: Oct. 27, 1998

[54] POSITIVE TEMPERATURE COEFFICIENT BAR SHAPED IMMERSION HEATER

[75] Inventors: Kevin L. Frank; Aime A. Gehri, both of Yakima, Wash.

[73] Assignee: Nine Lives, Inc., Yakima, Wash.

[21] Appl. No.: 638,175

[22] Filed: Apr. 26, 1996

[51] Int. Cl.[6] ..... H01C 7/02

[52] U.S. Cl. ..... 392/502; 392/501; 219/544

[58] Field of Search ..... 392/501, 502, 392/441, 401; 219/241, 505, 534, 537, 539, 541, 502, 544, 546; 338/22 R, 316, 328

[56] References Cited

U.S. PATENT DOCUMENTS

| | | | |
|---|---|---|---|
| 1,614,168 | 1/1927 | Abbott . | |
| 1,781,412 | 11/1930 | Slichter . | |
| 2,432,169 | 12/1947 | Morgan et al. | 219/38 |
| 2,475,989 | 7/1949 | Ronning | 219/38 |
| 2,698,374 | 12/1954 | Carpenter | 219/38 |
| 2,721,253 | 10/1955 | Langlois | 219/38 |
| 2,739,213 | 3/1956 | Beckjord | 201/67 |
| 2,820,133 | 1/1958 | Norton | 219/38 |
| 2,838,648 | 6/1958 | Ladue | 219/38 |
| 3,213,263 | 10/1965 | Steenbergen | 219/205 |
| 3,243,573 | 3/1966 | Weisse et al. | 219/213 |
| 3,286,082 | 11/1966 | Norton | 219/540 |
| 3,497,677 | 2/1970 | Blain | 219/523 |
| 3,519,023 | 7/1970 | Burns, Sr. et al. | 138/33 |
| 4,147,927 | 4/1979 | Pirotte | 219/541 |
| 4,395,618 | 7/1983 | Cunningham | 219/298 |
| 4,414,052 | 11/1983 | Habata | 156/273.7 |
| 4,558,210 | 12/1985 | Leary | 219/535 |
| 4,776,529 | 10/1988 | Tanis | 244/1 R |
| 5,017,758 | 5/1991 | Kirkman et al. | 219/205 |
| 5,105,063 | 4/1992 | Hockemier | 219/205 |
| 5,136,143 | 8/1992 | Kutner et al. | 219/544 |
| 5,278,940 | 1/1994 | Miller et al. | 392/485 |
| 5,633,978 | 5/1997 | Hofsass | 392/501 |

FOREIGN PATENT DOCUMENTS

| | | |
|---|---|---|
| 705522 | 3/1965 | Canada . |
| 782671 | 4/1968 | Canada . |
| 609147 | 9/1948 | United Kingdom . |

OTHER PUBLICATIONS

Omega Engineering, Inc.: "Self–Regulating Immersion Heaters" spec sheet.

Minco Products, Inc.: "Call Minco to solve your heating problem" advertisement (Thomas Register 1995).

Thermal Corporation: "Cartridge Heaters" advertisement (Thomas Register 1995).

Heatron, Inc.: "Heatrod Cartridge Heaters" advertisement (Thomas Register 1995).

Webb Enterprises, Inc.: "In–Tank Fuel Heater from WEBB" advertisement.

*Primary Examiner*—Tu B. Hoang

*Attorney, Agent, or Firm*—Stratton Ballew PLLC

[57] ABSTRACT

A method and apparatus for electrically heating fluid media with a bar shaped immersion heater is provided. The bar shaped immersion heater includes a thin strip heating element within a heat conductive bar. Electrical power is then connected to the thin heating element. The thin-strip heating element eliminates the hot spots found in coiled resistor wire immersion heaters. The heat conductive bar has a first bar and a second bar, the first bar and the second bar adjoin together, and the thin strip heating element is sandwiched between them. The heat conductive bar has fins to increase the surface area of the heat conductive bar. The fins project from the sides of the heat conductive bar to induce a convective flow around the heat conductive bar. The immersion heater has a small enough diameter to fit into a standard oil pan plug and the threads on the immersion heater are tapered to allow the heater to screw into a variety of hole diameters and into the varied materials and threads encountered with the large number of manufacturing standards for plug and drain holes.

17 Claims, 4 Drawing Sheets

POSITIVE TEMPERATURE COEFFICIENT BAR SHAPED IMMERSION HEATER

TECHNICAL FIELD

This invention relates to a method and apparatus for electrically heating fluid media, and more particularly to a method and apparatus for a bar shaped immersion heater.

BACKGROUND OF THE INVENTION

Electrical immersion heaters have long been used to heat fluids. The heating of fluids is necessary in many situations. At low temperatures, some fluids become a viscous or completely freeze. Other fluids require heating to elevated temperatures or boiling for process use. In the trucking industry, diesel powered engines are typically employed to power tractor and trailer rigs. These engines must perform on demand all year, including through the harsh cold of winter. Even during a short engine shutdown, the oil in the reservoir at the base of the engine begins to cool below the optimal operating temperature. Engine damage occurs when the oil is too viscous to adequately coat the moving metal parts of the engine. After an extended period in cold weather, the oil can become too viscous to be effectively pumped into the engine. In more severe cold, the oil can freeze making oil pumping impossible.

To prevent damage to the engine due to cold or frozen oil, a variety of heaters have been developed. One type of electrical heater used for engine oil heating is an immersion heater. By definition, electrical immersion heaters are immersed within the fluid to be heated and directly transfer heat generated within the heater by electrical resistance to the surrounding fluid. For use in oil heating, an immersion heater is typically placed within the oil sump or reservoir at the base of the engine, where oil accumulates and the engine's oil pump draws oil for circulation throughout the engine. Immersion heaters have other uses as well; they are ideal for heating almost any fluid stored in a tank, sump or reservoir.

Prior immersion heating devices typically employed a standard metal resistance conductor coiled around a ceramic insulator, covered by a metal sheath. These types of immersion heaters had several problems relating to safety, size and reliability, which will be discussed in the paragraphs that follow:

A heating unit with an electric element embedded in a metal bar is disclosed in the U.S. Pat. No. 3,286,082 to Norton. The Norton patent discloses a helical wire heating element embedded in a magnesia insulating material, surrounded with a metal bar or plate. The Norton patent fails to teach that the device would operate in a potentially explosive environment. With the expansions and contractions that a device of this type exhibits, the Norton device would undoubtedly allow oil to directly contact the heating element penetrating through the seams and joints in the device, creating an explosion hazard.

The U.S. Pat. No. 2,432,169 to Morgan et al. discloses an electric, screw-in immersion heater, intended for use in oil pans or tanks. The Morgan et al. device is proposed to heat with uniformity and without heating any part of the heater to a temperature at which cracking or carbonization may occur. To accomplish this feature, the Morgan et al. device encases a resistance wire, turned upon a refractory core to produce a substantially uniform temperature increase throughout the length of the refractory core. The Morgan et al. apparatus does, however, have "hot spots" by virtue of the overlapping coils and the linear nature of the generation of the electrical resistance heat. Hot spots are undesirable in immersion heaters especially when they are used to heat a volatile or combustible fluid, or in situations where the fluid may break down or convert to another material when it is heated above a given limit. For engine oil, this limit is the temperature at which the oil breaks down to shorter chained molecules, a process commonly called cracking. The oil may also "carbonize" at a temperature limit, creating a fouling carbon deposit in the engine or on the immersion heater. The fouling deposit of carbon reduces the thermal transfer and if left unchecked can cause the heater to overheat and fail because of the insulating effects of the carbon deposit. Therefore, an electric immersion heater is required that eliminates the hot spots found in coiled resistor wire immersion heaters.

The Morgan et al. apparatus also requires a "thermo-responsive bulb" to monitor the temperature of the device and regulate it to maintain a safe operating temperature. The use of such a thermostat is especially dangerous in oil immersion heaters. If the thermostat fails or detects an erroneous surface temperature of the heater, the heater becomes an ignition source for the surrounding oil. An electric immersion heater is needed that can operate without a thermostat or sensor to limit heat generated by the immersion heater.

Increasingly, larger diesel trucks and tractors are equipped with plastic oil pans. The use of plastic and other nonmetal materials in oil pans precludes the attachment of oil heaters to the exterior of the oil pan. Adhesive attachments to the high impact plastic oil pans quickly fail and magnetic attachment is impossible. The Morgan et al. apparatus might be able to fit into an oversized hole in a metal pan or tank, but fitting it into a typical small diameter hole in a oil pan would be impossible. Also, because of the soft nature of threads within plastic materials, plastic oil pans make an attachment by a threaded metal fitting difficult. This is especially true if the pan has a metric sized hole while the immersion heater has an externally threaded coupler with a diameter conforming to the English measurement system. An electric immersion heater is needed that can attach to plastic holes in a diameter range of typical oil pan drains encountered in domestic and foreign diesel trucks and tractors.

SUMMARY OF INVENTION

The invention provides a method and apparatus for electrically heating fluid media with a bar shaped immersion heater. The present invention includes a thin strip heating element within a heat conductive bar. Electrical power is then connected to the thin heating element.

In one aspect of the invention, the thin strip heating element has a positive temperature coefficient of electrical conductivity.

In another aspect of the invention, the heat conductive bar has a first bar and a second bar, the first bar and the second bar adjoin together, and the thin strip heating element is sandwiched between them.

In yet another aspect of the invention the heat conductive bar has fins to increase the surface area of the heat conductive bar.

In still another aspect of the present invention the fins project from the sides of the heat conductive bar to induce a convective flow around the heat conductive bar.

An advantage of the present invention is that the use of a thin-strip heating element in an immersion heater eliminates the hot spots found in coiled resistor wire immersion heaters. By applying the newly developed technology of "thin-strip"

heating elements in a novel way, this invention provides a much safer heater for flammable fluids. The thin-strip heater provides an even distribution of heat over the entire surface of the heater.

Another advantage of the immersion heater is that by employing a thin-strip heating element with a positive temperature coefficient, there is no need for a thermostat or sensor to limit heat generated by the immersion heater. A safer and more reliable immersion heater results, as compared to heaters employing coiled resistor wires.

Yet another advantage of the present invention is that the immersion heater has a small enough diameter to fit into a standard oil pan plug.

Still another advantage of the invention is that the threads on the immersion heater are tapered to allow the heater to screw into a variety of hole diameters and into the varied materials and threads encountered with the large number of manufacturing standards for plug and drain holes.

Additional features and advantages of the present invention are described in and will be apparent from the following detailed description. The invention will be better understood by reference to the detailed description of the presently preferred embodiments, taken together with the accompanying drawings.

DETAILED DESCRIPTION OF SPECIFIC EMBODIMENTS

The invention provides an apparatus for electrically heating fluid media. An embodiment of this apparatus is shown in FIGS. 1 through 6, herein.

Figure 1:
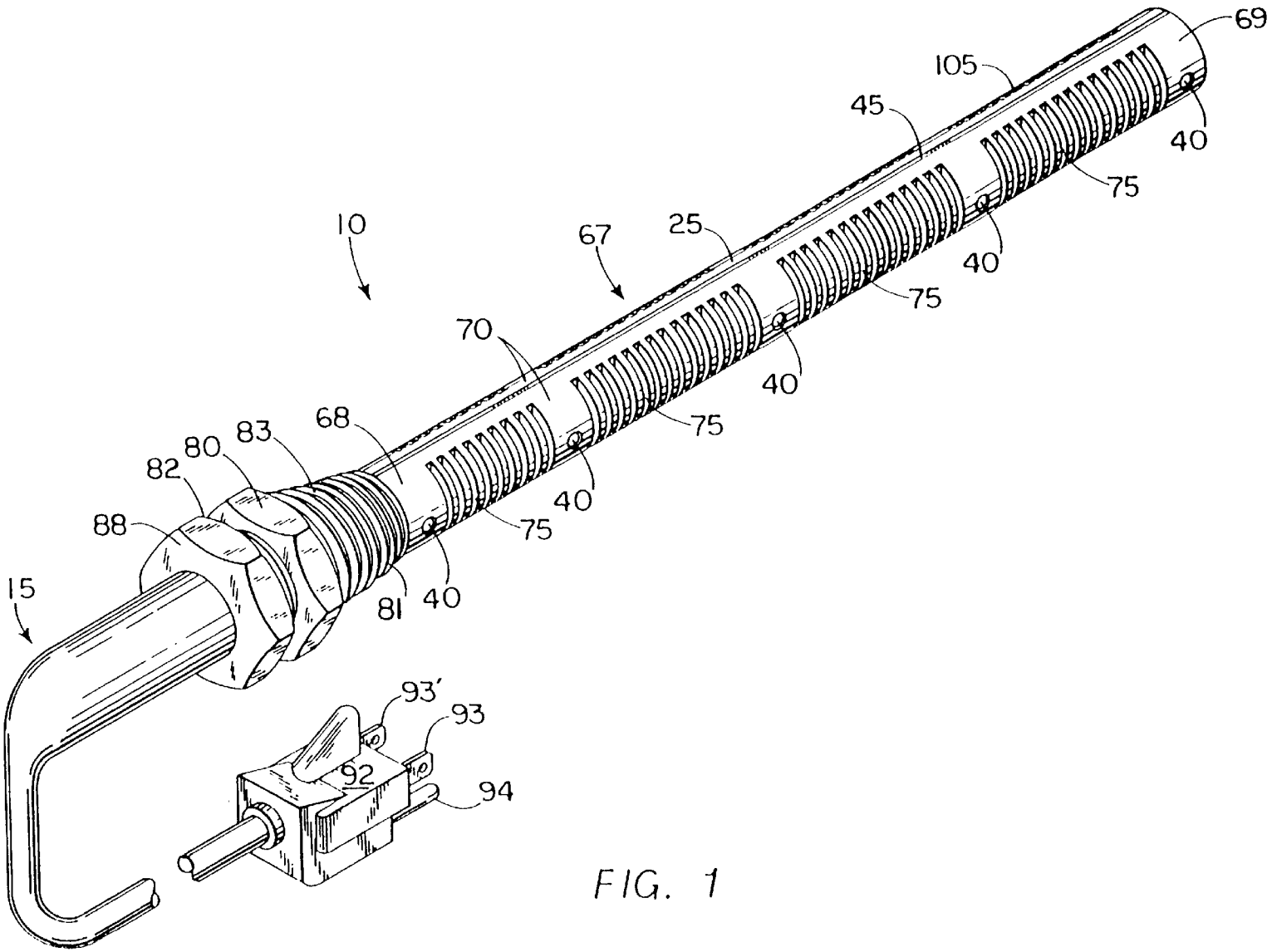
FIG. 1 is a perspective view of an immersion heater, according to an embodiment of the invention.

FIG. 1 shows a perspective view of the immersion heater 10, according to one embodiment of the invention, with an adaptor plug 15 specifically suited for connection to an American standard 110 volt electrical outlet. The function of the immersion heater is to warm fluid media (not shown) into which it is inserted. Fluid media is herein defined as liquids and gases with the ability to flow. Such fluid media includes gaseous mixtures like air, liquids such as water and more viscous liquids like cold motor oil.

Figure 2:
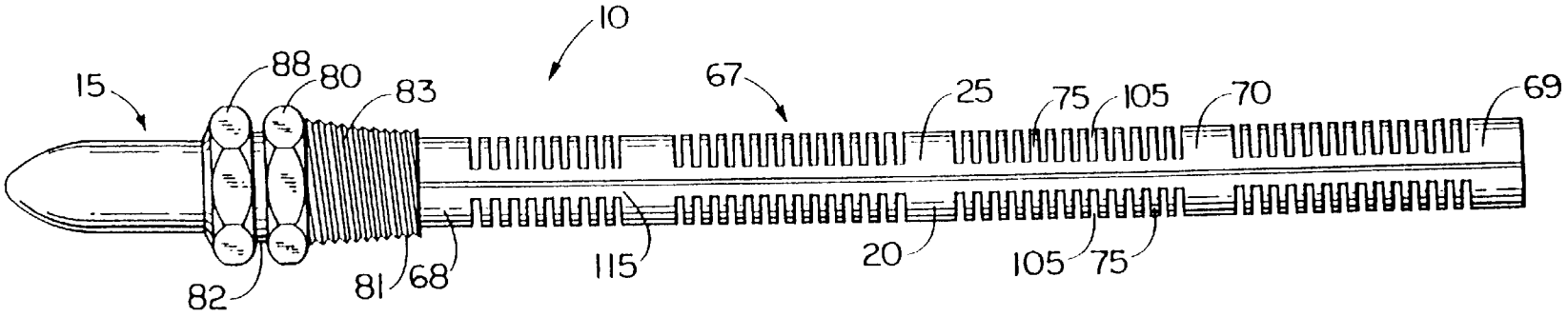
FIG. 2 is a plan view of an immersion heater, according to an embodiment of the invention.

FIG. 2 shows that the immersion heater 10 includes a first bar 20 and a second bar 25. Preferably, the first bar and the second bar are made of aluminum; however, any metal alloy, pure metal or other heat conductive substance with properties required in consideration of corrosion resistance, malleability or cost may be used. Ceramic and plastic materials are also considered, especially in applications where metals are undesirable due to spark potential or corrosion problems.

Alternatively, the first bar 20 and the second bar 25 can be a single bar (not shown) with internal space (not shown) formed lengthwise in the single bar. The internal space can be a slot, cavity or hole formed along the length of the single bar. Preferably, a single length of round bar stock is cut lengthwise into two equal halves, the first half defined as the first bar and the second half defined as the second bar. The internal space can be alternatively defined: When the first bar is adjoined to the second bar, the internal space is formed between the first bar and the second bar.

The first bar 20 and the second bar 25 are preferably fastened together at regular intervals with screws 40. Other possible fasteners include rivets, clamps and bands. Adhesives and solders could also be used; however, such fastening means would require the use of high melting point solders and adhesives able to withstand long periods of high heat.

The length of the immersion heater 10 is selectable to any desired length by the manufacturer. When used in truck or tractor oil heating applications, the immersion heater is preferably approximately nine inches in length. Other lengths are most certainly contemplated by the inventors. Other applications my require longer or shorter heaters. Heaters at least two feet in length are specifically considered for stock water tank heating applications and short heaters only one or two inches in length are considered for use in warming the oil in heat pump compressors.

Heating units employing an electric element embedded in a metal bar are known. With the expansions and contractions that devices of this type typically exhibit, they would undoubtedly allow oil to directly contact the heating element penetrating the seams and joints in the device, creating an explosion hazard. A solution to this problem is revealed in the present invention by applying the newly developed technology of "thin strip" heating elements in a novel way.

Thin strip heating elements employ an electrically conductive material with a positive-temperature-coefficient (PTC) material. PTC material is referred to as a thermistor, in that it uses "solid state," semiconductor technology. When an electric current flows through a PTC material, the material emits heat because of resistance to the electrical flow. As the temperature of the PTC material increases past a specified point, the resistance to the flow of the electrical current increases significantly, maintaining the temperature of the PTC element at that specific point. With PTC materials, thin "solid state" thermistor strip heating elements are possible. "Thin-strip" heating elements include an etched foil PTC thermistor affixed to a heat conductive but electrically insulating plastic or ceramic substrate. Substrates such as silicone, rubber, polyester, Kapton™, Nomex™ and mica are employed by the thin-strip heating element industry. For use with the present invention a thin-strip heating element 45 is preferred for use, with a PTC element 50 "sandwiched" and bonded between thin electrically insulative strips of substrate 55. A thin-strip etched foil heater element, manufactured by Heater Design Incorporated of Bloomington, Calif., performs adequately.

Additionally, the preferred thin-strip heating element 45 has a Kapton™ substrate 55 and is custom engineered and fabricated to meet the specifications required to perform in the present invention. The voltage and phase of electrical power to be used by the immersion heater 10 together with the wattage output required and the physical tolerances of the thin-strip heating element are supplied to a manufacturer. The manufacturer then designs the thin-strip heating element with the required specifications.

The use of alternating current or direct current power is also considered. The power input to the immersion heater 10 can be selected by the manufacturer, from low voltages to higher voltages, limited only by the capacities of the thin-strip heating element 45 and wiring connections 60 thereto.

The U.S. Pat. No. 4,414,052 to Habata et al. shows an aluminum finned heater with a positive-temperature-coefficient (PTC) heater element. However, Habata et al. fails to disclose any specific applications or apparatus employing the PTC element as attached to the aluminum finned heater. The Habata et al. invention relates only to the adhesion of a PCT element to metal components such as radiators.

The present invention applies a PTC element as known and disclosed in Habata et al. in a novel and unforeseen manner. The present device employs a PTC element 50 within a thin-strip heating element 45 that is receivable into the lengthwise internal space 30 of an immersion heater 10. Also, an immersion heater including a heat element simply contained within a sandwich of metal would likely result in an explosion or failure if a typical helical wire heating element was used instead of the thin-strip heating element. A wire resistance heater could not be sandwiched between metal bars to achieve the intrinsically safe heating of flammable fluids as achieved with the present invention.

Compared to placing the thin-strip heating element 45 into a slot formed in a single bar (not shown), an advantage is realized by sandwiching the thin-strip heating element between the first bar 20 and the second bar 25, so that it occupies the internal space 30. The slot formed in the metal bar is dictated by the width of the milling tool or saw blade used to form the slot. If the thin-strip heating element is thinner than the slot width, a gap is formed between the thin-strip heating element and the bar. This gap results in inefficient heat transfer from the thin-strip heating element even when it is filled with an appropriate heat transfer material.

The preferred lengthwise bisection of a single bar (not shown) into the first bar 20 and second bar 25 also allows the thin-strip heating element 45 to be more tightly fastened between, as compared to a slot formed in a single bar. The first bar and the second bar, when fastened together at regular intervals with screws 40, enable tight interfaces 63 and 63' to form between the thin-strip heater element and the first bar and similarly between the thin-strip heater element and the second bar. The tight interfaces are free from air bubbles that decrease the efficiency of heat transfer from the thin-strip heater element.

The PTC element 50 of the thin-strip heating element 45 typically includes a pair of flat foil electrical leads 65 and 65' for connection to a source of electrical power (not shown). For oil pan heating in trucks, tractors and other vehicles and machinery, single phase 110 volt electrical power is preferred; however, a battery powered 12 volt direct current supply is considered for the heating of automotive oil pans in situations where 110 volt current is not preferred or is unavailable. The inventor also conceives of small immersion heaters 10 with thin-strip heating elements that emit only fractions of a watt inserted into the lubricated reservoirs within moving parts, such as bearings or hinges. Further, it is conceived that immersion heaters with thin-strip heating elements can be sized to emit up to thousands of watts, for insertion into large tanks or reservoirs of fluids stored in cold environments or in the oil sumps of standby generators or turbines.

Preferably, in the embodiment of the immersion heater 10 for oil heating as herein described, the thin-strip heating element 45 is sized to generate approximately from 20 watts to 1,200 watts of heat, and most preferably generates 500 watts of heat. This quantity of heat generation is optimal for heating the oil in trucks, tractors and in other vehicles and machinery. For use within the oil pan of a typical automobile, a 65 watt immersion heater could be used. Motorcycles, snow-mobiles and snow-blowers could also benefit from the smaller immersion heater.

The thin-strip element heater 45 is sandwiched between the two halves of the bar that was bisected into the first bar 20 and the second bar 25. This assembly, which includes the thin-strip heating element between the first bar and the second bar, tightly held together by a plurality of screws or rivets, is defined herein as a bar heater section 67. The heater section has a base end 68 and a tip end 69. The base end is the end of the bar heater section that includes the electrical leads 65 and 65' of the PTC element 50. The tip end is the end of the bar heater that is opposite from the base end.

Fastening together the first bar 20 and the second bar 25 with an adhesive is also contemplated, as are bands or clips. The bands or clips would be preferably constructed of a metal with high tensile strength, however, other materials could be used.

Figure 4:
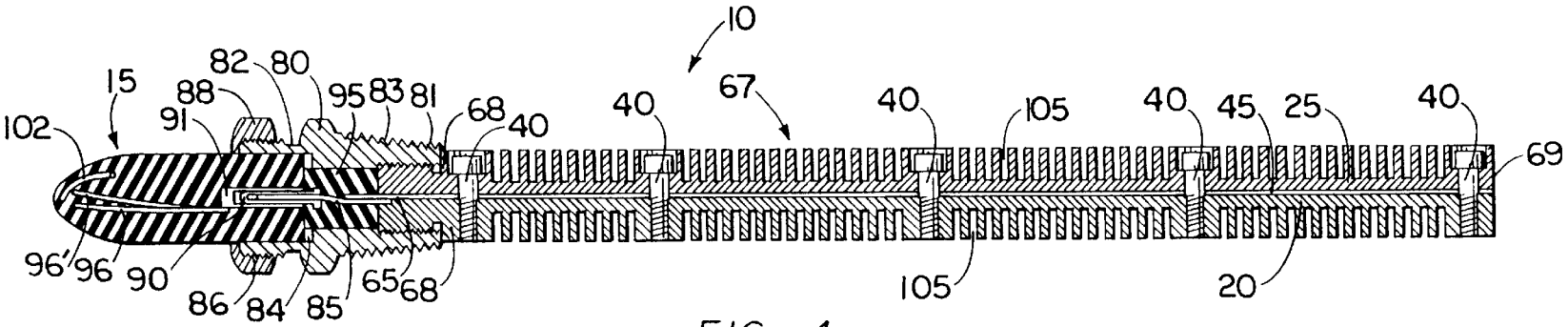
FIG. 4 is a sectioned plan view of an immersion heater, according to an embodiment of the invention.

Alternatively, a cap (not shown) on the tip end 69 of the heater bar section 67 can be employed to prevent the first bar 20 and the second bar 25 from separating away from the thin-strip heating element 45. Such separation tends to occur during the expansions and contractions encountered during temperature changes. The cap would preferably be constructed from aluminum and attached to the tip end by a small set screw (not shown). The cap could also be crimped to the tip end of the heater bar section, attached with an adhesive, soldered or received by a set of threads on the tip end, corresponding to a set of threads tapped into the cap. A screw 40 placed near the tip end 69 of the heater section as shown in FIG. 2 and 4 also prevents separation from the thin-strip heating element.

Preferably, the exterior surface 70 of the first bar 20 as attached to the second bar 25 is cut to create fins 75 which increase the area of the exterior surface. The fins may be lateral or longitudinal. The fins make it possible to more efficiently heat a body of fluid, while maintaining a lower temperature at the exterior surface. Too high of an exterior surface temperature causes excessive fouling and burning or carbonization for the fluid in oil heating applications. Too high of an exterior surface temperature also results in cracking and a greater possibility of fires because the exterior surface provides a possible ignition source. Compared to a smooth-surfaced heater with equivalent wattage and the same general dimensions, a finned heater will intrinsically have a lower surface temperature and transfer the heat to the engine oil more efficiently than the smooth surfaced design.

The present invention preferably emits approximately 12.5 watts per square inch of the bar heater section 67. Though a heat emission approximately 12.5 watts per square is ideal for oil pan heating in diesel trucks and the like, although higher or lower watt per square inch emissions are conceived. Fluids that break-down or volatilize at lower temperatures than typical motor oil would likely require a lower heat emission per unit area. Higher heat emission rates would be desirable for use with fluid that volatilize at higher temperatures or are less susceptible to break-down, such as carbonizing or cracking.

A coupler 80, preferably ⅝ inch in diameter and has a heater end 81 and a connector end 82. Preferably, the heater end is internally threaded with 18 BNC standard threads per inch, is affixed to the base end 68 of the heater section. The coupler is preferably cylindrical with cap threads 86 and mounting threads 83. The cap threads are external on the coupler and located at the connector end of the coupler. The mounting threads are also external and located on the heater end of the coupler. The coupler also has an internal volume 84. A pair of power supply wires 85 and 85' run through the internal volume of the coupler, connecting one of the electrical leads 65 and 65' of the PTC element 50 to one of a pair of one inch length connector pins 90 and 90'. The connector wires are preferably copper with an American Wire Gauge of 18.

Additionally, the internal volume 84 of the coupler 80 is preferably filled with an epoxy 95. Hobby brand of 30 minute curing epoxy manufactured by Duponte® of Wilmington, Del., performs adequately to seal the base end 68 of the bar heater section 67 and lock the coupler in place in relation to the heater bar section and the electrical leads 65 and 65' of the PTC element 50.

As shown in FIGS. 1, 2, 3, 4 and 5, the adaptor plug 15 firmly inserts into the coupler 80 to connect the connector pins 90 and 90' to the electrical power source (not shown). Preferably, a cap nut 88 is receivable to the connector end 82 of the coupler. The cap nut tightens down upon the adaptor plug, insuring a tight and weather proof connection. The connector pins each mate into a corresponding connector socket 91 and 91', within the adaptor plug. Preferably, the heater is designed to use standard 110 volt, single phase, alternating current. Alternatively, direct current power could be utilized by the heater. A generator or battery could also supply the electrical power necessary for the PTC element 50. The adaptor plug terminates with a plug 92 of standard three-prong design for use in a conventional 110 volt electrical outlet that includes a first prong 93 and a second prong 93'. An American standard 110 volt, single phase plug is shown in FIGS. 1 through 6, however, any plug could be employed to suit the desired application. The first prong and the second prong are electrically connected to the connector sockets 91 and 91' respectively, by way of connector wires 96 and 96'. The connector wires are preferably copper with an American Wire Gauge of 18.

Figure 5:
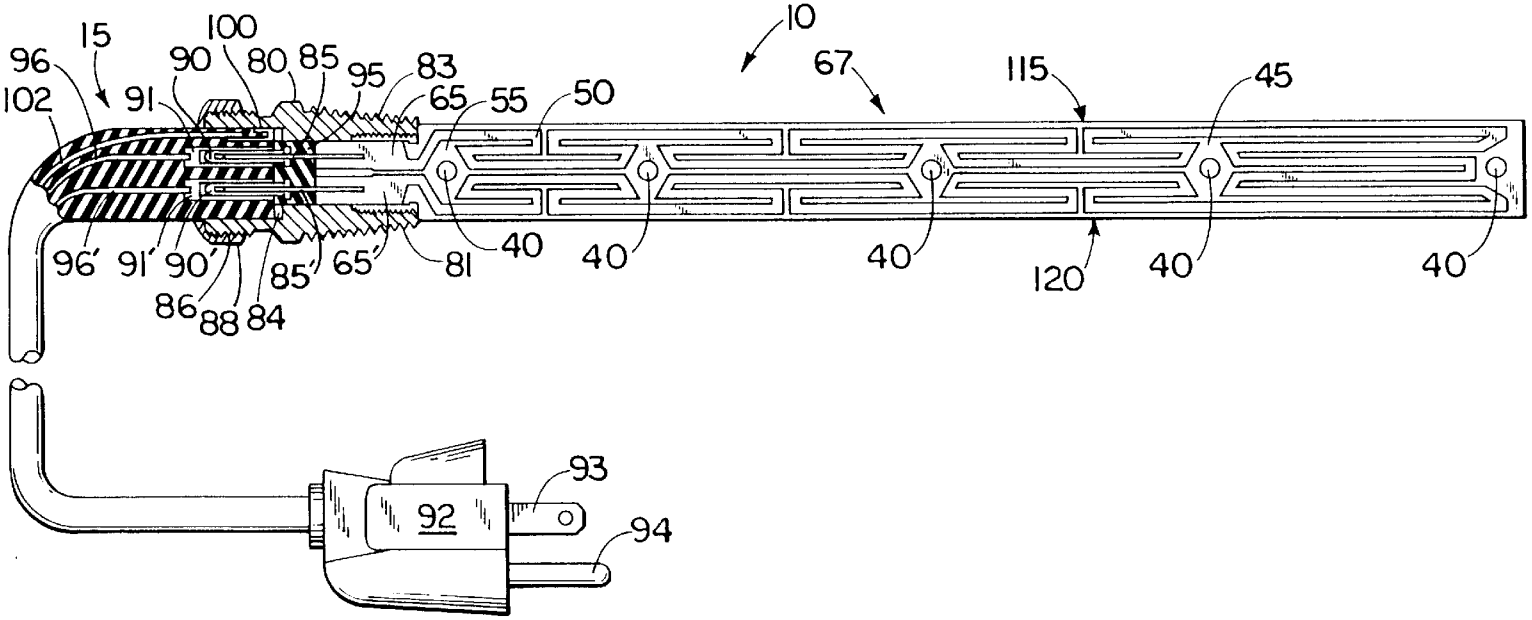
FIG. 5 is a sectioned side view of an immersion heater, according to an embodiment of the invention.
Figure 6:
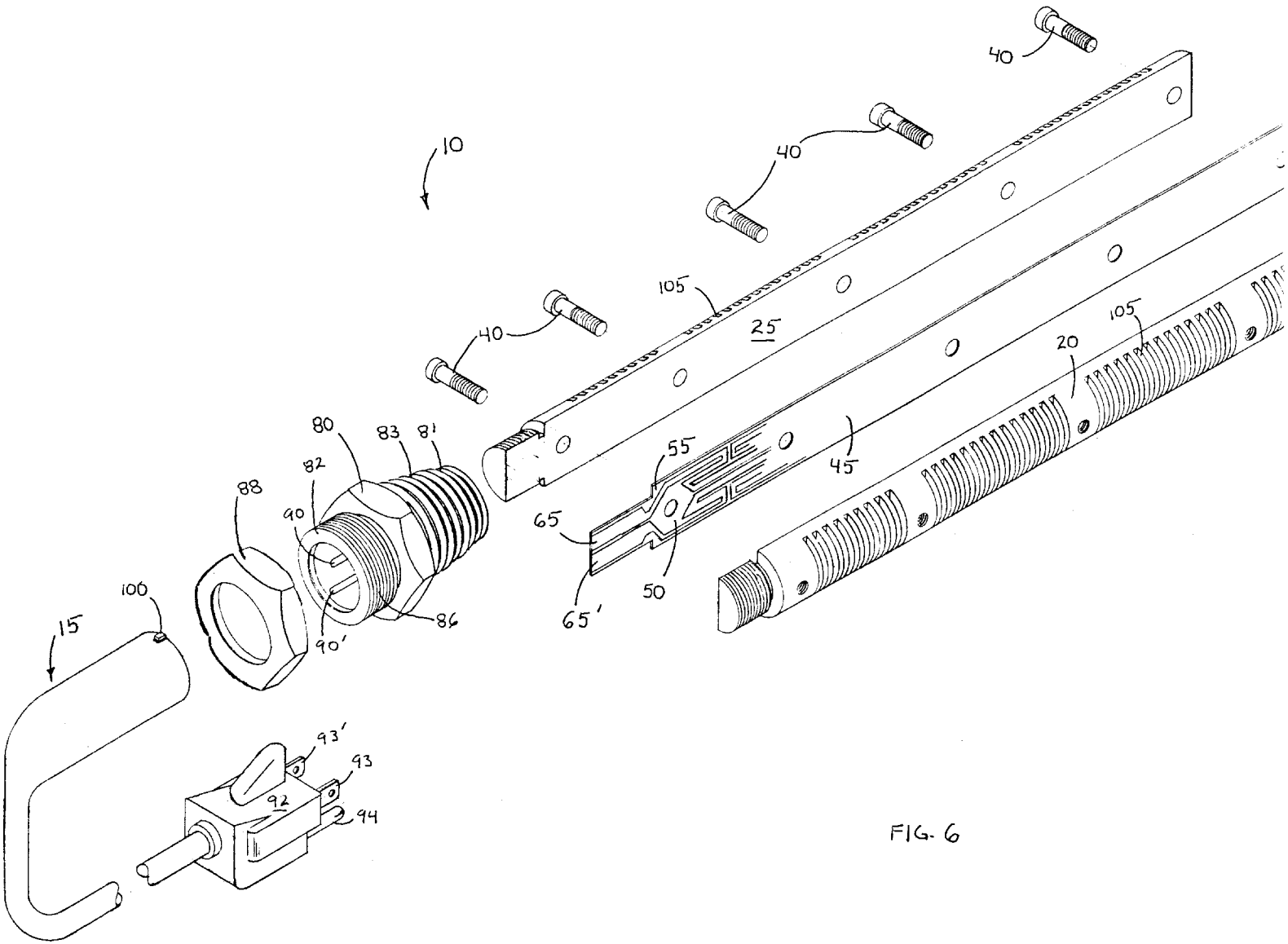
FIG. 6 is an exploded perspective of an immersion heater, according to an embodiment of the invention.
Figure 6:
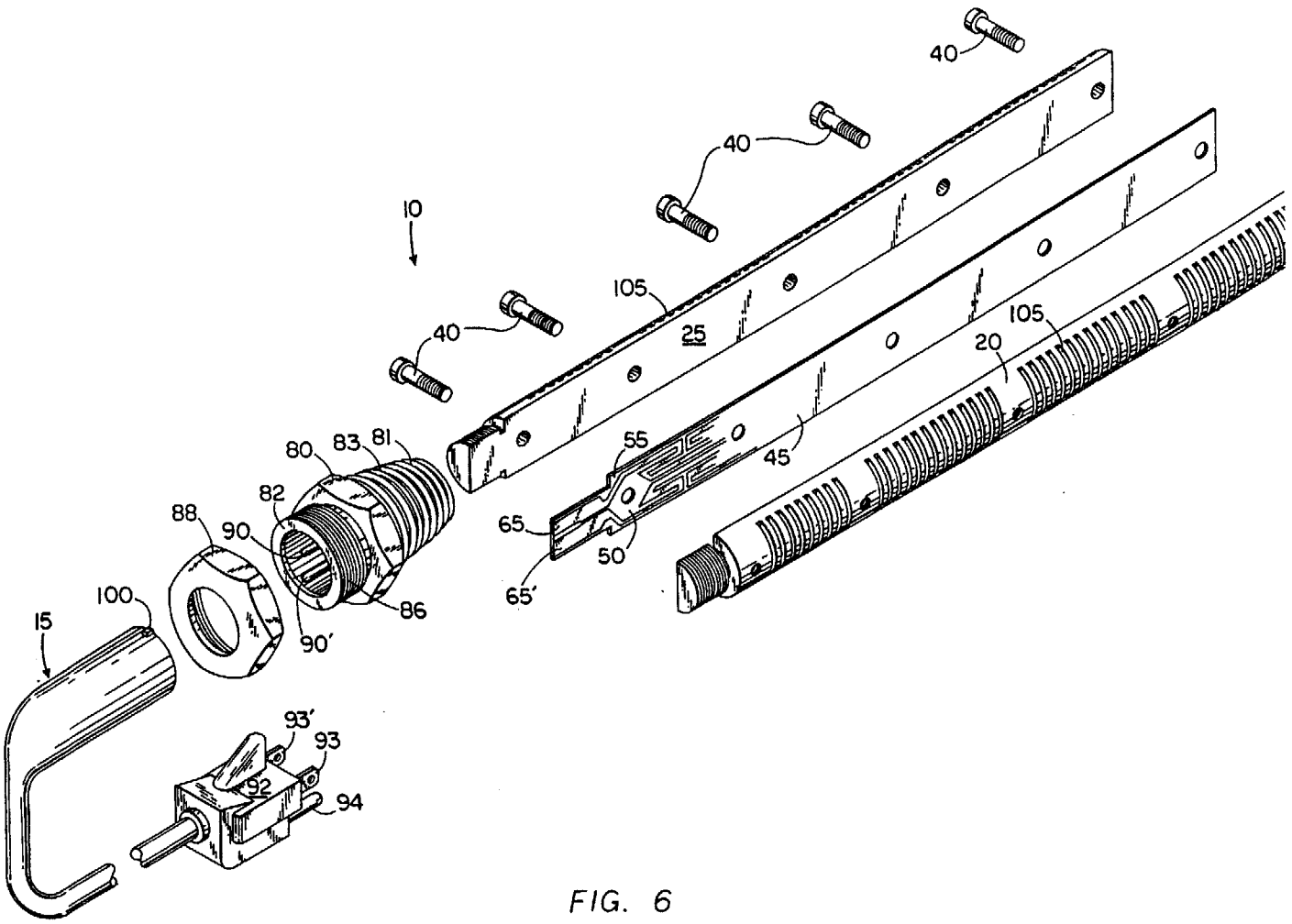

Additionally, a third prong 94 of the three-pronged plug 92 is a ground connection. Preferably, a grounding pin 100 adjoins directly to the coupler 80 and is most preferably integrated into the adaptor plug 15, as shown in FIGS. 5 and 6. The grounding pin connects to a ground wire 102 of the adaptor plug. The ground wire then connects to the third prong of the three pronged plug. The grounding pin helps ensure that the heater does not become an ignition source due to a buildup of an electrical potential between the immersion heater 10 and the fluid (not shown) such as oil surrounding it.

The immersion heater 10 is installed by inserting the heater bar section 67 through an external penetration (not shown) of a reservoir, tank or container of oil, water, hydraulic fluid, or any fluid that is desired to be maintained at a temperature higher than the ambient temperature. The external penetration is preferably tapped with internal threads to receive the mounting threads 83 on the heater end 81 of the coupler 80.

Since oil pans are of no particular standard material and do not include a standard drain plug penetration, it is preferred to taper the mounting threads 83 on the coupler 80. A trend in vehicle oil pans is toward fabrication from high impact plastics and fibrous materials. The tapered external threads allow the coupler to tightly bind the internal threads of the penetration (not shown) into the fluid reservoir (not shown), securely mounting the immersion heater 10 in place. Also, the tapered mounting threads of the immersion heater help ensure a tight fit into an off-sized penetration.

Preferably, the immersion heater 10 includes slots 105 as shown in FIGS. 1 through 4 and in FIG. 6. In this embodiment, the slots are cut laterally across the bar heater section 67. A bar heater section with a diameter of 0.75 inches fits into most truck and tractor oil pans, through the drain penetration typically bored in the base of the pan. The laterally cut slots are preferably 0.09 inches in width and cut at regular intervals of 0.18 inches along the length of the bar heater section. The width and separation of the slots are easily varied to suit the application and the material selected for the bar heater section. The exterior surface 70 area of a nine inch length bar heater section is almost doubled by the addition of the lateral slots. At regular intervals along the bar heater section, the slots are omitted to allow a screw hole 110 to penetrate through the first bar 20 and into the second bar 25. The screw hole is preferably tapped with 10–32 threads and countersunk to each receive screws 40 made preferably of stainless steel, that can be screwed level with the exterior surface 70 of the first bar 20.

The bar heater section 67 has a 22 square inch exterior surface 70 area without the slots 105 and fins 75 compared to a 40 square inch exterior surface area when the slots and fins are included. The slots are preferably cut into the bar heater section to form the fins with a standard milling process. Alternatively the bar heater section could be extruded from continuous stock with the slots included and then cut to a desired width and rounded to an oval or round cylindrical shape and bisected to receive the thin-strip heating element 45. Another alternative is to cast the bar and include fins as desired to minimize milling and cutting.

Optionally, longitudinal slots (not shown) may be cut into the bar heater section 67. The longitudinal slots could be cut to produce radial fins running the length of the bar heater section, with breaks in the slots to allow screws 40 to connect the first bar 20 to the second bar 25. An extrusion of the bar with longitudinal slots is also possible. A continuous extrusion, preferably including fins, would be cut to a length desired for the bar heater section, then bisected lengthwise to receive the thin strip-heating element 45.

Figure 3:
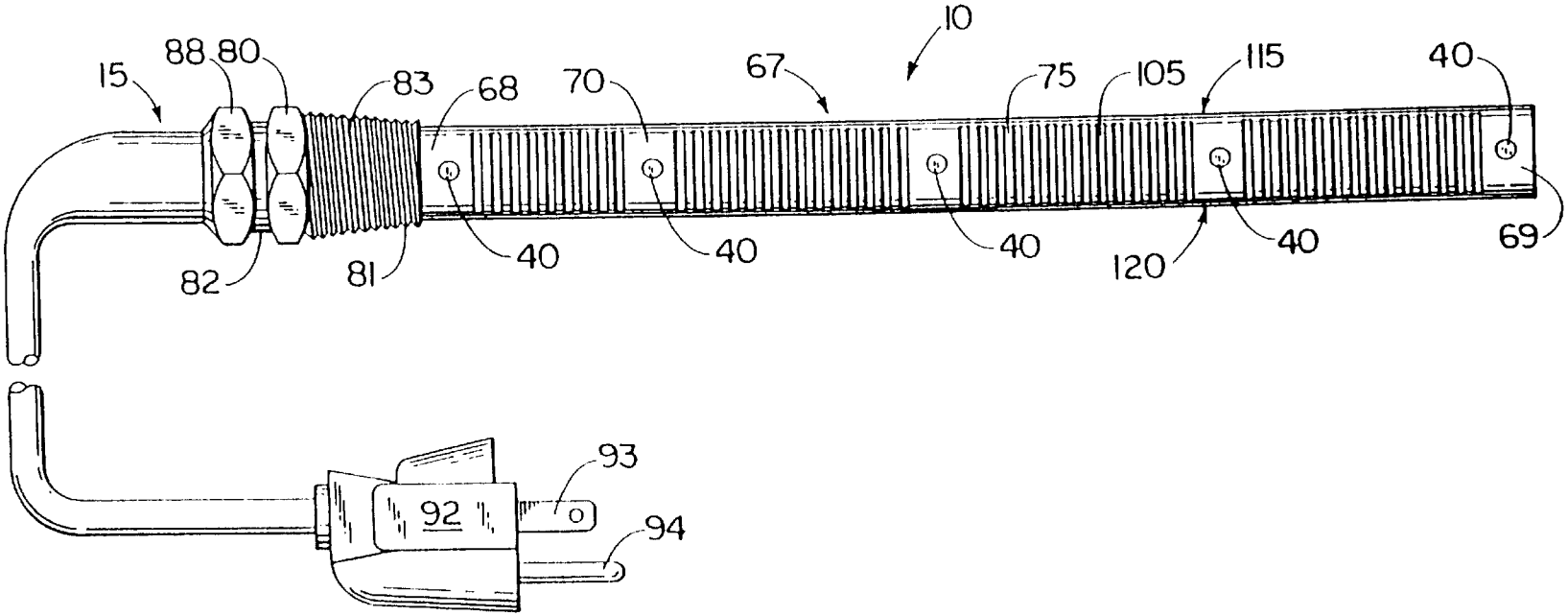
FIG. 3 is a side view of an immersion heater, according to an embodiment of the invention.

The advantages of lateral fins over longitudinal fins include the ability of the lateral fins to induce circulating flow around the bar of the immersion heater 10, especially when the immersion heater is operated in an approximately horizontal position, as preferred. As the surrounding fluid (not shown) is heated by the immersion heater it will naturally rise. With the fins oriented to extend from the bar heater section 67 in the horizontal plane as shown in FIGS. 1, 2, 3, 4 and 6, convection currents formed in the surrounding fluid will naturally induce flow through the slots 105. As the fluid contacting the exterior surface 70 of the immersion heater warms, it naturally rises and is replaced by the cooler fluid directly below the immersion heater. The flowing fluid is thus exposed to a maximum area of the external surface of the heater and conducts the surface heat of the immersion heater in an efficient manner. The lack of additional slots on the top surface 115 and bottom surface 120 of the bar heater section, as shown in FIG. 3, allows the thin-strip heater element 45 to run from the tip end 69 to the base end 68 of the bar heater section as shown in FIG. 4. And so, the absence of additional slots increases the area of the thin-strip heater to a maximum relative to the total width of the bar heater section.

If slots 105 were included in the top surface 115 and bottom surface 120 of the bar heater section 67, the width of the thin-strip heater element 45 would need to be reduced to allow for the slots. A narrower thin-strip heater element with the same wattage output as the preferred thin-strip heater element would need a higher wattage per unit area to maintain the same wattage output and have a smaller area to dissipate the generated heat. This is undesirable in that a higher temperature thin-strip heater element is unsafe in a combustible fluid. A narrower thin-strip heater element is also more prone to short circuits due to the resultant reduction in electrically insulative substrate 55.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. It is therefore intended that such changes and modifications be covered by the appended claims.

What is claimed is:

1. An apparatus for electrically heating a fluid media, which comprises:

a heat conductive bar having a lengthwise internal space;

a thin strip heating element received into the lengthwise internal space of the heat conductive bar;

the thin strip heating element having a positive temperature coefficient of electrical conductivity and an electrical power connection means for supplying electrical power to the thin strip heating element.

2. The apparatus of claim 1, wherein the heat conductive bar is metal.

3. The apparatus of claim 1, wherein the thin strip heating element has an attached bi-polar electrical connection, and the electrical power connection means for supplying electrical power connects to the bi-polar electrical connection.

4. The apparatus of claim 1, wherein the heat conductive bar includes a first bar and a second bar, the first bar and the second bar adjoin together, and the internal space is between the first bar and the second bar of the heat conductive bar.

5. The apparatus of claim 4, wherein the first bar and the second bar are held together with a fastening means.

6. The apparatus of claim 1, wherein the heat conductive bar has exterior fins for increasing the surface area of the heat conductive bar.

7. The apparatus of claim 6, wherein the exterior fins project from the sides of the heat conductive bar to induce convective flow of the fluid around the heat conductive bar.

8. The apparatus of claim 1, wherein the heat conductive bar has a diameter and the diameter is equal to an external penetration diameter of an external penetration, the external penetration formed into a fluid reservoir, and the external penetration for receiving the heat conductive bar.

9. The apparatus of claim 8, wherein the diameter of the heat conductive bar is approximately equal to a typical oil pan plug diameter, and the heat conductive bar includes a means for attachment to the fluid reservoir at the external penetration.

10. An apparatus for electrically heating fluid media, which comprises:

a heat conductive bar having a lengthwise internal space and a surface area, the heat conductive bar including a first bar and a second bar, the first bar and the second bar adjoined together with a fastening means, the lengthwise internal space is between the first bar and the second bar of the heat conductive bar, the heat conductive bar has an exterior fins for increasing the surface area of the heat conductive bar, the heat conductive bar has a diameter equal to a diameter of a bore hole;

the exterior fins project from the sides of the heat conductive bar to induce convective flow of the fluid around the heat conductive bar;

a thin strip heating element receivable into the lengthwise internal space of the heat conductive bar, the thin strip heating element having a positive temperature coefficient of electrical conductivity, the thin-strip heating element has an attached bi-polar electrical connection; and an electrical power connection means for supplying electrical power connects to the bi-polar electrical connection of the thin-strip heating element.

11. A method for electrically heating a fluid media, comprising the steps of:

laterally bisecting a heat conductive bar into a first bar and a second bar;

inserting a thin-strip heating element having a positive temperature coefficient of electrical conductivity between the first bar and the second bar; and assembling a bar heater section by sandwiching the thin-strip heating element between the first bar and the second bar.

12. The method of claim 11, for electrically heating fluid media, additionally including the step of cutting multiple slots in the bar heater section.

13. The method of claim 11, for electrically heating fluid media, additionally including the step of cutting multiple lateral slots in the bar heater section.

14. The method of claim 11, for electrically heating fluid media, additionally including the step of cutting multiple longitudinal slots in the bar heater section.

15. The method of claim 11, for electrically heating fluid media, additionally including the step of cutting multiple radial slots in the bar heater section.

16. The method of claim 11, for electrically heating fluid media, additionally comprising the steps of:

connecting the thin-strip heating element to an electrical power source;

inserting the bar heater section into a fluid; and heating the fluid surrounding the bar heater section.

17. The method of claim 11, for electrically heating fluid media, additionally comprising the step of:

connecting the thin-strip heating element to an electrical power source;

inserting the bar heater section into oil within an oil reservoir of a vehicle; and heating the oil surrounding the bar heater section.

* * * * *

UNITED STATES PATENT AND TRADEMARK OFFICE

CERTIFICATE OF CORRECTION

PATENT NO. : 5,828,810

DATED : October 27, 1998

INVENTOR(S) : Kevin L. Frank and Aime A. Gehri

It is certified that error appears in the above-identified patent and that said Letters Patent is hereby corrected as shown below:

On the cover page, please replace the drawing with the formal drawing labeled "Fig. 6" which is attached hereto.

On page 4 of the drawings, please replace Fig. 6 with the formal drawing labeled "Fig. 6" which is attached hereto.

Signed and Sealed this

Sixth Day of April, 1999

*Attest:*

Q. TODD DICKINSON

*Attesting Officer*

*Acting Commissioner of Patents and Trademarks*

US005828810A

United States Patent [19]

Frank et al.

[11] Patent Number: 5,828,810

[45] Date of Patent: Oct. 27, 1998

[54] POSITIVE TEMPERATURE COEFFICIENT BAR SHAPED IMMERSION HEATER

[75] Inventors: Kevin L. Frank; Aime A. Gehri, both of Yakima, Wash.

[73] Assignee: Nine Lives, Inc., Yakima, Wash.

[21] Appl. No.: 638,175

[22] Filed: Apr. 26, 1996

[51] Int. Cl.[6] ..... H01C 7/02

[52] U.S. Cl. ..... 392/502; 392/501; 219/544

[58] Field of Search ..... 392/501, 502, 392/441, 401; 219/241, 505, 534, 537, 539, 541, 502, 544, 546; 338/22 R, 316, 328

[56] References Cited

U.S. PATENT DOCUMENTS

| | | | |
|---|---|---|---|
| 1,614,168 | 1/1927 | Abbott . | |
| 1,781,412 | 11/1930 | Slichter . | |
| 2,432,169 | 12/1947 | Morgan et al. | 219/38 |
| 2,475,989 | 7/1949 | Ronning | 219/38 |
| 2,698,374 | 12/1954 | Carpenter | 219/38 |
| 2,721,253 | 10/1955 | Langlois | 219/38 |
| 2,739,213 | 3/1956 | Beckjord | 201/67 |
| 2,820,133 | 1/1958 | Norton | 219/38 |
| 2,838,648 | 6/1958 | Ladue | 219/38 |
| 3,213,263 | 10/1965 | Steenbergen | 219/205 |
| 3,243,573 | 3/1966 | Weisse et al. | 219/213 |
| 3,286,082 | 11/1966 | Norton | 219/540 |
| 3,497,677 | 2/1970 | Blain | 219/523 |
| 3,519,023 | 7/1970 | Burns, Sr. et al. | 138/33 |
| 4,147,927 | 4/1979 | Pirotte | 219/541 |
| 4,395,618 | 7/1983 | Cunningham | 219/298 |
| 4,414,052 | 11/1983 | Habata | 156/273.7 |
| 4,558,210 | 12/1985 | Leary | 219/535 |
| 4,776,529 | 10/1988 | Tanis | 244/1 R |
| 5,017,758 | 5/1991 | Kirkman et al. | 219/205 |
| 5,105,063 | 4/1992 | Hockemier | 219/205 |
| 5,136,143 | 8/1992 | Kutner et al. | 219/544 |
| 5,278,940 | 1/1994 | Miller et al. | 392/485 |
| 5,633,978 | 5/1997 | Hofsass | 392/501 |

FOREIGN PATENT DOCUMENTS

| | | |
|---|---|---|
| 705522 | 3/1965 | Canada . |
| 782671 | 4/1968 | Canada . |
| 609147 | 9/1948 | United Kingdom . |

OTHER PUBLICATIONS

Omega Engineering, Inc.: "Self-Regulating Immersion Heaters" spec sheet.

Minco Products, Inc.: "Call Minco to solve your heating problem" advertisement (Thomas Register 1995).

Thermal Corporation: "Cartridge Heaters" advertisement (Thomas Register 1995).

Heatron, Inc.: "Heatrod Cartridge Heaters" advertisement (Thomas Register 1995).

Webb Enterprises, Inc.: "In-Tank Fuel Heater from WEBB" advertisement.

*Primary Examiner*—Tu B. Hoang

*Attorney, Agent, or Firm*—Stratton Ballew PLLC

[57] ABSTRACT

A method and apparatus for electrically heating fluid media with a bar shaped immersion heater is provided. The bar shaped immersion heater includes a thin strip heating element within a heat conductive bar. Electrical power is then connected to the thin heating element. The thin-strip heating element eliminates the hot spots found in coiled resistor wire immersion heaters. The heat conductive bar has a first bar and a second bar, the first bar and the second bar adjoin together, and the thin strip heating element is sandwiched between them. The heat conductive bar has fins to increase the surface area of the heat conductive bar. The fins project from the sides of the heat conductive bar to induce a convective flow around the heat conductive bar. The immersion heater has a small enough diameter to fit into a standard oil pan plug and the threads on the immersion heater are tapered to allow the heater to screw into a variety of hole diameters and into the varied materials and threads encountered with the large number of manufacturing standards for plug and drain holes.

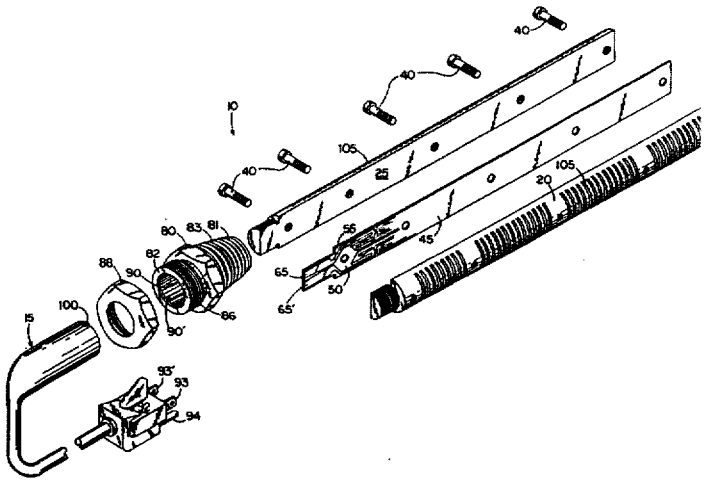

17 Claims, 4 Drawing Sheets